US006129535A

United States Patent [19]

Becher

[11] Patent Number: 6,129,535

[45] Date of Patent: Oct. 10, 2000

[54] TWIN FEED SCREW

[75] Inventor: Ulrich Becher, Porrentruy, Switzerland

[73] Assignee: Ateliers Busch S.A., Chevenez, Switzerland

[21] Appl. No.: 09/077,965

[22] PCT Filed: Jul. 8, 1996

[86] PCT No.: PCT/CH96/00251

§ 371 Date: Aug. 24, 1998

§ 102(e) Date: Aug. 24, 1998

[87] PCT Pub. No.: WO97/21926

PCT Pub. Date: Jun. 19, 1997

[30] Foreign Application Priority Data

Dec. 11, 1995 [CH] Switzerland ..... 3488/95
Dec. 21, 1995 [CH] Switzerland ..... 3628/95

[51] Int. Cl.[7] ..... F01C 1/16
[52] U.S. Cl. ..... 418/201.3
[58] Field of Search ..... 418/201.3

[56] References Cited

U.S. PATENT DOCUMENTS 5,697,772 12/1997 Kawamura et al. ..... 418/201.3

FOREIGN PATENT DOCUMENTS 62291486 12/1987 European Pat. Off. .
956840 9/1982 U.S.S.R. ..... 418/201.3
746628 3/1956 United Kingdom .
2165890 4/1986 United Kingdom ..... 418/201.3

*Primary Examiner*—Hoang Nguyen
*Attorney, Agent, or Firm*—Clifford W. Browning; Woodard, Emhardt, Naughton, Moriarty & McNett

[57] ABSTRACT

In known embodiments, media are fed in a contact-free manner in propeller pumps by single-thread twin feed screws which are guided via pilot gears, the twin feed screws having the same transverse profile with a core circle, tip circle, an involute flank and a hollow flank, enabling the pump chamber to be divided into axially staggered cells and this obtain high pressure differences in one stage. In addition to dynamics, efficiency and production, the control of the medium is also determined by the contour of the end profile, the variation of which improves all the dependent variables. According to the invention, the involute is replaced by a curve which does not rise constantly and has a central saddle region and a smooth connection to the core circle. The variations in the end face achieved thereby improve the dynamics and volumetric efficiency and extend the possibilities for controlling medium at the end face. The detailed adaption to the new curve together with the smooth connection at the base point enable the core and flanks to be produced jointly by a single tool. Feed screws with profiles of this type are suitable for flow rates of between 100 and 1000 $m^3/h$ and ultimate pressure of <0.05 mbar at speeds of rotation of approximately 3000 $min^{-1}$ and approximately 50% efficiency.

4 Claims, 3 Drawing Sheets

TWIN FEED SCREW

Figure 1:
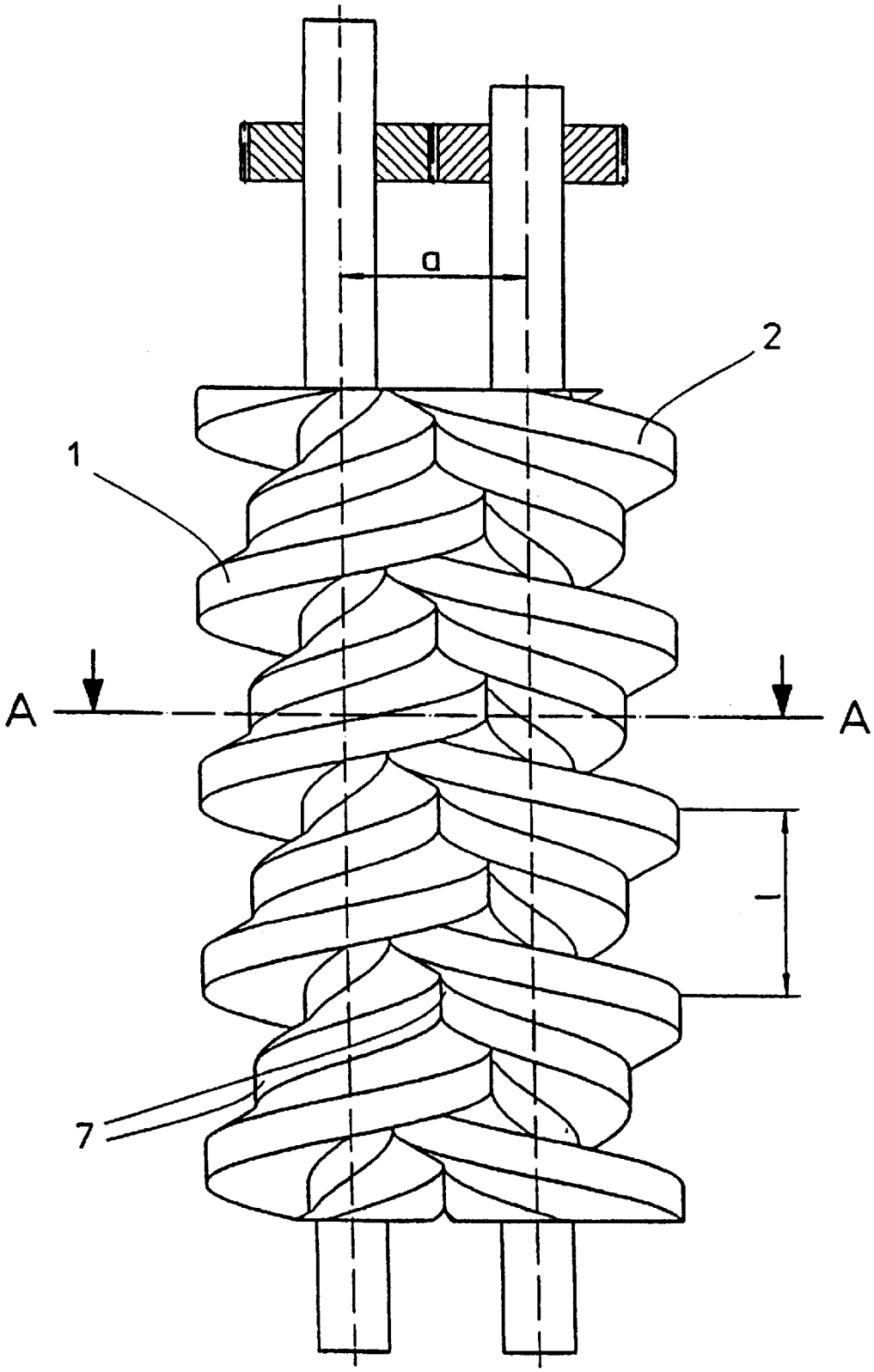

The invention relates to the profile geometries of double conveying worms for a parallel-axis outer-axis operation in pumps with pilot gear systems, for counter-flight guidance of the worms. Profile geometry, angle of contact, pitch, gap width, medium control, and rotation speed determine in this situation the pump characteristics such as conveying volume, degree of efficiency, final pressure, leakage rate, temperature, noise, and investment in manufacture.

The geometries known as the SRM profile from the company SRM, Sweden, are well-suited for the construction of fast-rotating double conveying worms with irregular profiles in multi-flight design and small angles of contact for pumps with final pressure in the middle range. Gaps incurred by the design between the engagement line and the inner edge of the housing, generally known as the "blow-hole", prevent higher final pressures or good volumetric degrees of efficiency at lower and medium speeds of rotation.

In the present case, however, interest is focused on pumps of higher final pressures in medium peed ranges, for which single-flight double worms with axial sequence of the operating cells and angles of contact >720° are better suited. By designing one flank in each case of the single-flight profiles as an extended cycloid, alternating symmetrical lines of engagement are formed, which run along the outer contours of the worm from the inner edges of the housing to the core circles. These lines of engagement subdivide the interior of the pump into axially-migrating operating cells with twice the pitch length in an overlapping arrangement.

In known embodiments, such as are available, for example, from the company Taiko, Japan, the worms are manufactured with angles of contact of 1080°, 1440°, 1800°, etc., which feature identical end profiles. The outlet is controlled on the end side by one of the worms, with an aperture along the second profile flank, which at that point is involute-shaped.

While maintaining the operational principle of the axially-migrating operating cells with double the length of pitch, the intention is to redesign and redefine the profile geometry in the sense of modern series manufacture, and it is also intended to improve the volumetric degree of efficiency, the dynamic behaviour, and the control of the medium.

This objective is achieved according to the invention with double conveyor worms with profile contours with core circles, cycloid-shaped hollow flanks, outer arcs, and a second flank, in that, as a departure from the prior art, the second flank 6, referred to as the cover flank, is also connected at the foot point without a fold to the core circle 4, and that the cover flank 6 contains at least one middle area which does not rise in pitch, containing the saddle support 7, which connects the part cover flanks formed in this manner, the inner flank 8 and the outer flank 9, free of folds.

On the basis of the embodiments shown in the drawings and characterised in Sub-Claims 2, 3, the invention is described in greater detail.

The drawings show:

FIG. 1: A double worm system in single-flight design with pilot gears and with angles of contact of approx. 1600° according to the invention, with a middle saddle support range in the cover flank, in a reduced scale.

Figure 2:
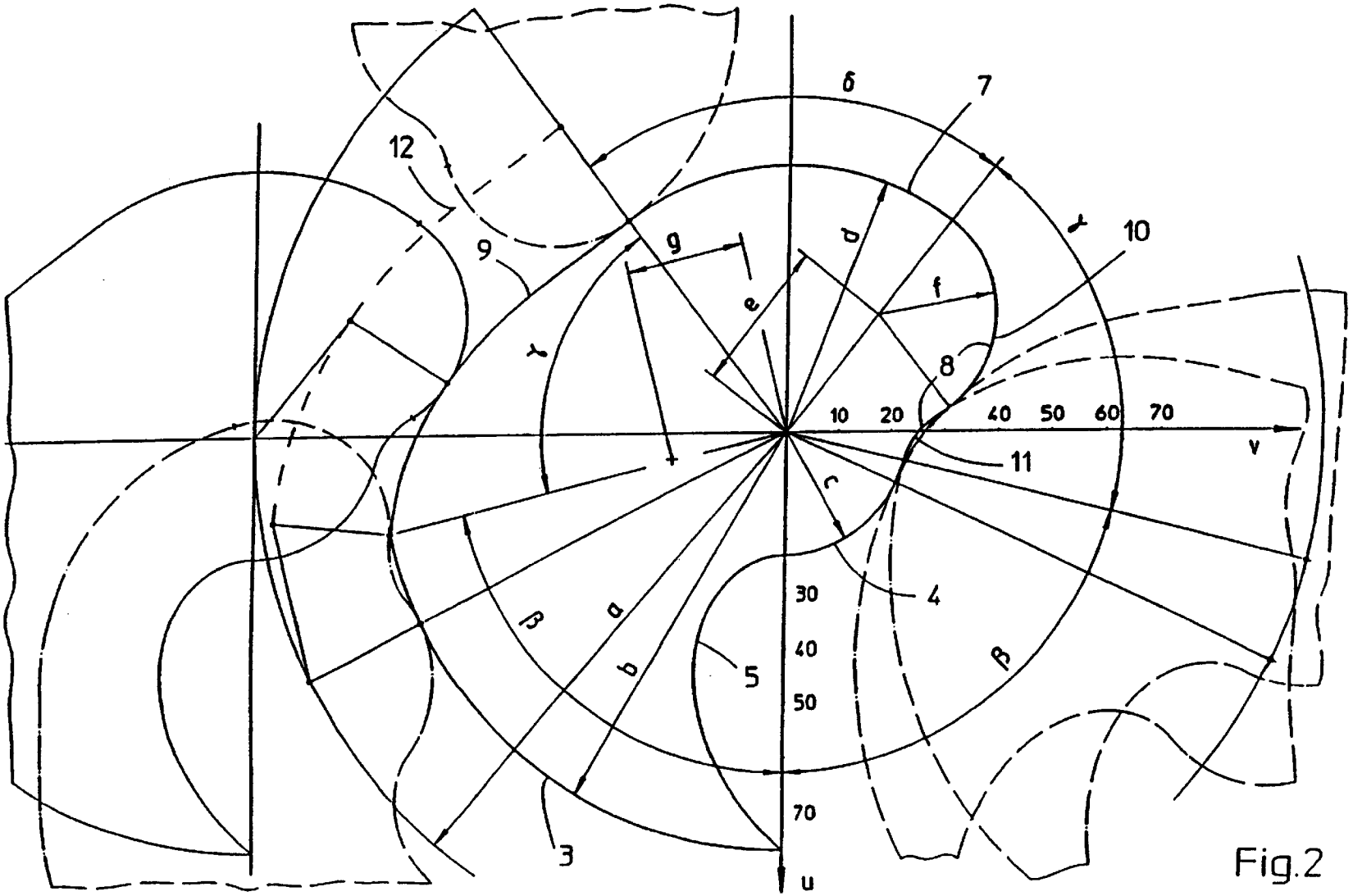

FIG. 2: An embodiment of the profile geometry and the engagement proportions with the counter-profile of a double worm system from FIG. 1.

Figure 3:
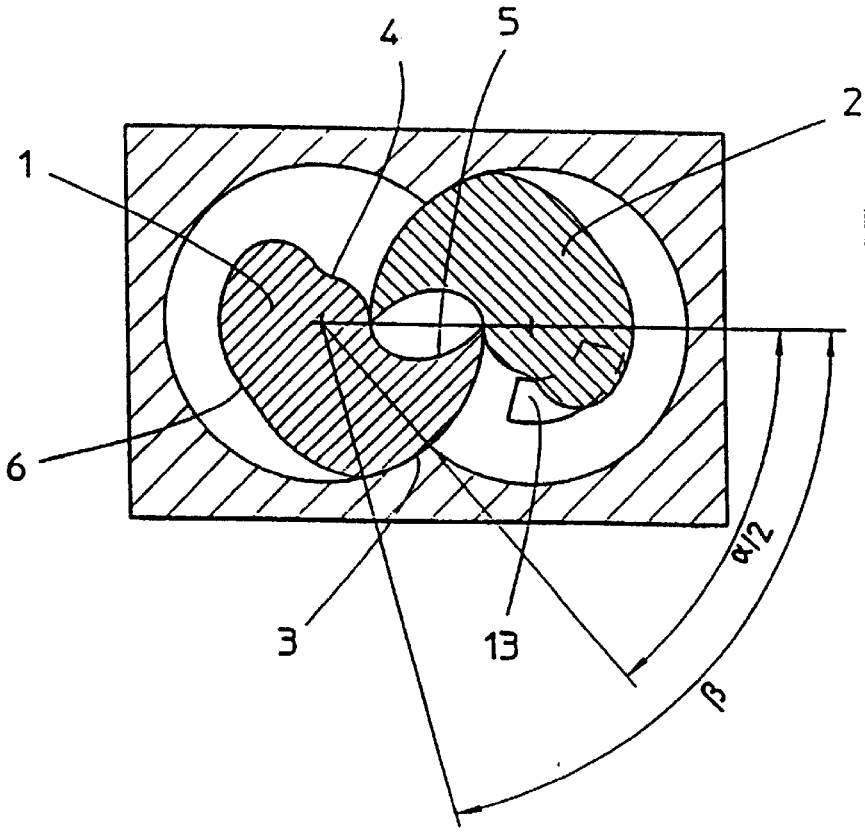

FIG. 3: An embodiment of the double worm system shown in section, according to the line A—A in FIG. 1, installed in a housing, in the same scale as FIG. 1.

Figure 4:
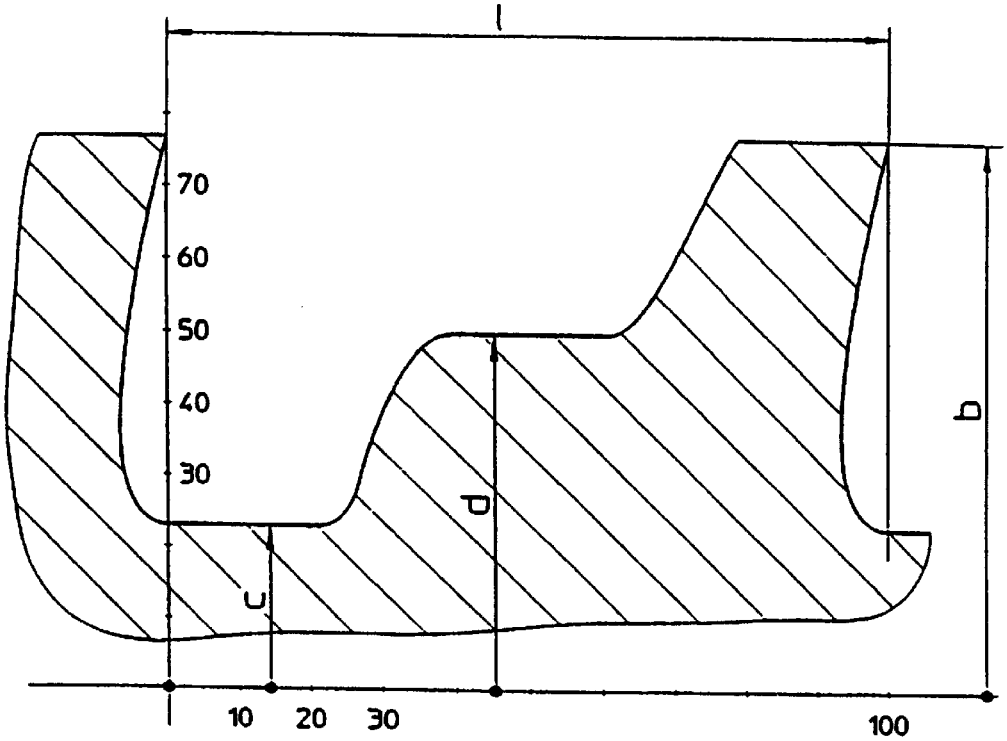

FIG. 4: An embodiment of the conveying worms in an axial section, in sections.

In the embodiment chosen, the conveying worms 1, 2 (FIGS. 1 and 3) have angles of contact of approx. 1600° and the same end profiles with a cover flank composed of several part flank curves: The saddle support 7 (FIGS. 1 and 2) is arc-shaped, with a radius of the size of a half distance between axes, and corresponds in the installation with the saddle support of the counter-worm. The inner flank 8 (FIG. 2) consists of an eccentric arc which connects free of folds to the saddle support 7, in this case referred to as the flank arc (FIG. 2), and an extended cycloid connected free of folds, the root cycloid 11 (FIG. 2), for connection to the core circle 4 (FIGS. 2 and 3). The mid-point of the flank arc of the counter-worm moves in relation to the profile under consideration on a shortened epicycloid 12 (FIG. 2), the inner parallel curve of which is the outer flank 9 (FIG. 2) of the profile under consideration, at the distance interval of the flank circle radius f.

For the quantitative determination, the following procedure is applied:

1. Determination of the distance between axes: a=100 L.U. (length units).
2. From this, the saddle support arc radius is derived directly: d=a/2=50 L.U.
3. Determination of the core circle radius: c=23 L.U.
4. From this, the outer arc radius is derived directly: b=a−c=77 L.U.
5. With a and b the hollow flank cycloid 5 (FIGS. 2 and 3) is calculated. A number of values are shown in Table 1, where u, v are the co-ordinates of a right-angled co-ordinate system with origin in the axis centre.
6. From a and b the immersion angle $\alpha$ is derived, which indicates the range of mutual penetration of the interlocking conveyor worms 1, 2 (FIG. 3): $\alpha/2=49.51°$.
7. Determination of the outer arc sector angle $\beta$: To maintain the function, $\beta$ must be greater than $\alpha/2$. Determination of $\beta=76°$. Because of the counter-engagement of the same profile, the core circle sector angle is likewise $\beta=76°$.
8. Determination of the worm pitch: 1=100 L.U.
9. The values 1, a, b, and the requirement for common machining of the flanks 5, 6 and the core 4 with one tool, calculation leads via the axial section (FIG. 4) to a condition for the flank arc radius of $f \geqq 22$ L.U. Determination: f=22 L.U., from which the eccentricity e of the flank arc centre is derived: e=d−f=28 L.U.
10. The root cycloid 11 is created by the head corner at the point of impact between the outer arc/outer flank of the counter-profile, and, because of the same lever condition a, b, is congruent with a part of the hollow flank 5. With the fold-free connection of the flank arc 10 and the core circle 4 by the root cycloid 11, the inner flank sector angle is derived: $\gamma=65.94°$. Because of the counter-engagement of the same profile, the outer flank sector angle is likewise $\gamma=65.94°$.
11. The saddle support sector angle is therefore $\delta=360°-2\beta-2\gamma=76.12°$.
12. The values a, e, f lead to the contour of the outer flank 9, a section of an inner parallel curve to a truncated epicycloid. A number of values are listed in Table II, where u, v correspond to the definition of Table I.

After the determination of the profile contour, it then follows:

13. Centre of gravity distance from centre g=21.58 L.U.
14. Rotor surface=Z=8295.4 $(L.U.)^2$ and therefore $g \cdot z = 1.79 \cdot 10^5 (L.U.)^3$.
15. Degree of efficiency $\eta=49.51\%$.

16. From the operating speed and the geometry data is derived the relative conveying capacity in (L.U.)$^3$/time unit, from which the value for 1 L.U. is derived by correlation with the corrected reference conveying capacity. With a reference conveying capacity of 250 m$^3$/h (uncorrected) and a speed of 3000 rpm, there is derived: 1 L.U.=1 mm.

The measurement corrections now carried out on the profile for contact-free operation are indeed essential for perfect function and manufacture, and do involve considerable investment of effort, but they play only a subordinate role in the selection of the profile.

A comparison with known profiles shows an improvement in the volumetric degree of efficiency of approximately 6.5% points, an improvement in dynamics (g·z reduced by 27.2%), and a common determination possibility of the inner surface of the flight altogether, formed by the core 4, hollow flank 5, inner flank 8, saddle support 7, and outer flank 9. The surface proportion in the area of the flank arc allows for better adjustment of the control of the medium, guided via channels 13 (FIG. 3) in the housing end wall.

TABLE I

| u (L.U.) | v (L.U.) |
|---|---|
| 23 | 0 |
| 23.63 | −4.18 |
| 24.97 | −7.24 |
| 26.40 | −9.32 |
| 27.92 | −10.97 |
| 28.71 | −11.68 |
| 29.53 | −12.34 |
| 31.21 | −13.48 |
| 32.98 | −14.44 |
| 34.81 | −15.23 |
| 36.72 | −15.86 |
| 38.69 | −16.34 |
| 40.72 | −16.67 |
| 42.80 | −16.86 |
| 44.93 | −16.90 |
| 47.10 | −16.78 |
| 49.30 | −16.52 |
| 51.54 | −16.11 |
| 53.80 | −15.55 |
| 56.07 | −14.83 |
| 58.35 | −13.96 |
| 60.64 | −12.92 |
| 62.92 | −11.73 |
| 65.18 | −10.38 |
| 67.42 | −8.86 |
| 69.63 | −7.18 |
| 71.80 | −5.34 |
| 73.92 | −3.33 |
| 75.99 | −1.15 |
| 77 | 0 |

TABLE II

| u (L.U.) | v (L.U.) |
|---|---|
| −39.37 | −30.82 |
| −33.98 | −38.03 |
| −31.69 | −41.22 |
| −29.85 | −43.79 |
| −28.20 | −46.05 |
| −26.64 | −48.12 |
| −25.12 | −50.05 |
| −23.62 | −51.88 |
| −22.10 | −53.63 |
| −20.55 | −55.30 |
| −18.97 | −56.92 |
| −17.33 | −58.49 |
| −15.64 | −59.99 |

TABLE II-continued

| u (L.U.) | v (L.U.) |
|---|---|
| −14.78 | −60.73 |
| −12.08 | −62.85 |
| −10.20 | −64.20 |
| −8.24 | −65.48 |
| −6.20 | −66.71 |
| −4.09 | −67.88 |
| −1.90 | −68.97 |
| +0.37 | −70.00 |
| +1.54 | −70.48 |
| +2.73 | −70.95 |
| +5.17 | −71.81 |
| +7.69 | −72.59 |
| +10.30 | −73.28 |
| +12.99 | −73.87 |
| +15.77 | −74.35 |
| +17.19 | −74.54 |
| +18.63 | −74.71 |

What is claimed is:

1. Double conveying worms for axis-parallel, counter-running outside engagement, with angles of contact of at least 720° and designed as single-flight with end profile contours formed from a core circle portion, a first cycloid-shaped hollow flank, a second flank and an outer arc portion, wherein the second flank forms a cover flank and connects free of folds to the core circles at a foot point of the profile, wherein the hollow flank also connects free of folds to the said core circle, the said hollow flank, cover flank and core circle portion thus forming a fold-free common surface able to be machined commonly; and wherein the cover flank features at least one central non-rising area shaped as a saddle, said saddle portion thus connecting two cover flank portions forming an inner flank and an outer flank respectively, whereby a surface distribution is achieved which insures determined effects on degree of efficiency, dynamics, and medium control, the profile being therefore more favourable that known profiles from the said points of view.

2. Double conveying screw according to claim 1, wherein the cover flank is composed of several flank part curves, in such a way that the saddle portion is designed in the shape of an arc.

3. Double conveying worms according to claim 2, wherein the inner flank of each worm is composed of an eccentric arc, referred to here as the flank arc, and of an extended cycloid, designated as the root cycloid, in such a way that the root cycloid connects to the core circle and the flank arc is connected to the saddle portion, the said outer flank thus having a design such that engagement of the counter-worm in each case adopts the shape of the inner parallel arcs of a truncated epicycloid.

4. Double conveyor worms for axis-parallel, counter-running outside engagement, with angles of contact of at least 720° and designed as single-flight with end profile contours, formed with core circles, a first cycloid-shaped hollow flank, outer arcs and second flank, wherein the second flank, referred to as the cover flank, also connects free of folds to the core circles at the foot point, with the result that the hollow flank and the cover flank together with the core form a fold-free surface with common machining potential; wherein the cover flank features at least one central non-rising area, the saddle, which combines the part cover flanks thus formed, the inner flank and the outer flank, wherein said cover flank is composed of several flank part curves, in such a way that the saddle support is designed in the shape of an arc, and wherein said inner flank is composed of an eccentric arc, referred to here as the flank arc, and an extended cycloid, designated as the root cycloid, in such a way that the root cycloid connects to the core circle and the flank arc is connected to the saddle support, with the result that the outer flank, conditioned by the engagement of the counter-worm in each case, adopts the shape of the inner parallel arcs of a truncated epicycloid, as a result of which a surface distribution is achieved which is more favourable in relation to known profiles, of such a nature that an increase is achieved in the volumetric degree of efficiency, an improvement in dynamics, and better control of the medium output and ballast gas intake.

* * * * *

UNITED STATES PATENT AND TRADEMARK OFFICE

CERTIFICATE OF CORRECTION

PATENT NO. : 6,129,535
DATED : October 10, 2000
INVENTOR(S) : Ulrich Becher

It is certified that error appears in the above-identified patent and that said Letters Patent is hereby corrected as shown below:

Column 1,
Line 19, please insert the following paragraph:

-- In Document GB-A-746 628, a displacement machine is described with single-flight rotors, working in a counter direction of rotation. Each rotor is provided with a concave side in the shape of an epicycloid, and a convex side. The angles of contact are $\geq 360^{\circ}$. With this rotor design, there is no blowhole; the rotors accordingly operate at medium speeds in a satisfactory manner for numerous applications. --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*